US009631474B2

(12) United States Patent
Livescu et al.

(10) Patent No.: US 9,631,474 B2
(45) Date of Patent: Apr. 25, 2017

(54) SYSTEMS AND METHODS FOR REAL-TIME EVALUATION OF COILED TUBING MATRIX ACIDIZING

(71) Applicant: Baker Hughes Incorporated, Houston, TX (US)

(72) Inventors: Silviu Livescu, Calgary (CA); Trevor A. Sturgeon, Calgary (CA); Thomas J. Watkins, Calgary (CA)

(73) Assignee: BAKER HUGHES INCORPORATED, Houston, TX (US)

( * ) Notice: Subject to any disclaimer, the term of this patent is extended or adjusted under 35 U.S.C. 154(b) by 0 days.

(21) Appl. No.: 14/088,966

(22) Filed: Nov. 25, 2013

(65) Prior Publication Data

US 2015/0144331 A1 May 28, 2015

(51) Int. Cl.

| | |
|---|---|
| ***E21B 4/18*** | (2006.01) |
| ***E21B 47/00*** | (2012.01) |
| ***E21B 47/01*** | (2012.01) |
| ***E21B 47/06*** | (2012.01) |
| *E21B 43/26* | (2006.01) |

(52) U.S. Cl.

CPC ..... *E21B 47/00* (2013.01); *E21B 47/01* (2013.01); *E21B 47/065* (2013.01); *E21B 43/26* (2013.01)

(58) Field of Classification Search

CPC ..... E21B 4/18; E21B 44/005; E21B 47/065; E21B 49/003

USPC ..... 166/250.01

See application file for complete search history.

(56) References Cited

U.S. PATENT DOCUMENTS

| | | | | |
|---|---|---|---|---|
| 6,874,361 | B1 * | 4/2005 | Meltz | E21B 43/14 73/152.32 |
| 8,113,284 | B2 * | 2/2012 | Jee et al. | C12N 13/00 166/250.01 |
| 2008/0239872 | A1 * | 10/2008 | Miller et al. | E21B 47/042 367/83 |
| 2010/0148785 | A1 * | 6/2010 | Schaefer et al. | 324/338 |

FOREIGN PATENT DOCUMENTS

WO 2013/085479 A1 6/2013

* cited by examiner

*Primary Examiner* — Doug Hutton. Jr.
*Assistant Examiner* — Ashish Varma
(74) *Attorney, Agent, or Firm* — Shawn Hunter

(57) ABSTRACT

A matrix acidizing monitoring system wherein a sensor array is operably associated with a matrix acidizing bottom hole assembly and contains first and second sets of sensors that detect a matrix acidizing operational parameter at different times at one or more particular locations along the wellbore. This allows the effectiveness of the acidizing to be modeled.

15 Claims, 4 Drawing Sheets

SYSTEMS AND METHODS FOR REAL-TIME EVALUATION OF COILED TUBING MATRIX ACIDIZING

BACKGROUND OF THE INVENTION

1. Field of the Invention

The invention relates generally to use of matrix acidizing in subterranean hydrocarbon formations. In particular aspects, the invention relates to techniques for helping to evaluate the effectiveness of matrix acidizing.

2. Description of the Related Art

Matrix acidizing is a stimulation process wherein acid is injected into a wellbore to penetrate rock pores. Matrix acidizing is a method applied for removing formation damage from pore plugging caused by mineral deposition. The acids, usually inorganic acids, such as fluoridic (HF) and or cloridic (HCl) acids, are pumped into the formation at or below the formation fracturing pressure in order to dissolve the mineral particles by chemical reactions. The acid creates high-permeability, high productivity flow channels called wormholes and bypasses the near-wellbore damage. The operation time depends on such parameters as the length of the wellbore, the rock type, the severity of the damage, acid pumping rate, downhole conditions and other factors.

Matrix acidizing is also useful for stimulating both sandstone and carbonate reservoirs. Matrix acidizing efficiency in removing the formation damage is strongly dependent on the temperature at which the acidizing occurs and weakly dependent upon the corresponding pressure. The acid temperature in the formation depends on the convective heat transfer as the acid flows through the formation and on the reaction heat transfer due to the acid-mineral reaction.

Convective heat transfer is the main mechanism for temperature change during acid flow through wormholes. The acid temperature in the wormholes may vary by as much as 10-20° C. (18-36° F.), depending on the initial temperature difference between wellbore and the formation. The acid temperature at the end of the wormholes, about 1-10 m (3.3-33 feet) from the wellbore, may increase by 1°-5° C. (1.8°-8° F.) above the formation temperature at those locations, depending on the injected acid volume.

Along a wormhole, the temperature changes over time as illustrated by FIG. 4. Initially, the temperature near the wellbore is the acid temperature inside the well ($T_w$ at t=0). The rest of the wormhole, which may be partially or totally undeveloped, is assumed to be at the formation or reservoir temperature ($T_r$ at t=0), which is greater than the wellbore temperature. As time progresses and acid is injected through the wormhole, at small radial distances near the wellbore (up to about 1 m (3.3 feet)), the acid temperature decreases from $T_r$ to $T_w$ with time at a rate depending upon the temperature drop of the fluid flowing from the wellbore. In other words, in the near well region, the temperature behavior depends only on the convection heat transfer due to the acid flow through the wormhole.

At distances further away than about 1 meter (3.3 feet) and at the advancing acid front region, the acid temperature increases from the well temperature to the formation temperature. This temperature increase is still due mainly to convection heat transfer. However, in the transition between the two temperature levels, the reaction heat transfer between the acid and minerals changes the temperature behavior by smoothing out the temperature change on one side closer to the well and by uplifting the formation temperature by about 1°-5° C. (1.8°-8° F.) on the other side, as FIG. 4 illustrates. The acid temperature changes in both regions (near well and near the acid front). It increases with time and distance due to two mechanisms. First, it depends on the time needed by the acid and minerals to react completely. Second, it depends on the contact area between acid and minerals which increases rapidly with distance. After the acid injection is stopped, the acid-mineral reactions may still continue for some time. However, these reactions take place further away from the well, where the acid front is located. Even the local temperature at the acid front may still increase after the acid injection is stopped. This temperature increase is small and cannot be recorded in the near-well region, so it can be ignored in all additional calculations. At the time when the acid injection is stopped, the temperature along the wormhole is decreasing from almost formation temperature at the wormhole end away from the well ($T_r$ at $t=t_s$) to the well temperature ($T_w$ at $t=t_s$) near the well. As time progresses, the temperature wave moves toward the well at a speed depending upon the wormhole properties (geometry, length, thermal conductivity) and formation properties (porosity, permeability, thermal conductivity, etc.). Eventually, without acid flow, the well temperature ($T_w$) increases until it reaches the formation temperature ($T_r$) at time $t=t_f$. Thus, the total time in which the well temperature varies is $t_f$. If the acid injection is started and stopped at times t=0 and $t=t_s$, respectively, between 0 and $t_s$, the well temperature decreases from $T_w$ at t=0 to $T_w$ at $t=t_s$. This is illustrated by FIG. 5. Between $t_s$ and $t_f$, the well temperature increases from $T_w$ at $t=t_s$ to $T_w$ at $t=t_f$. The time in which the matrix acidizing performance can be evaluated is thus between 0 and $t_f$ or between $t_s$ and $t_f$, depending on the evaluation technique. In addition to temperature, when the acid flow between the well (annulus) and the formation through wormholes, the local pressure drops due to the change in flow area (such as from the annulus area to the wormhole area). The pressure drop may not be relevant if there is no acid flow. Also, it is worth noting that the temperature and pressure may vary meaningfully only around wormholes (i.e., where there is radial acid flow between the well and the formation).

Methods for monitoring and evaluating matrix acid stimulations have long been investigated. Recently, distributed temperature sensing ("DTS") technology has emerged as a tool for real-time data acquisition and interpretation for evaluating matrix acidizing performance. Although the main advantages of this technique (i.e., real time temperature data acquisition along the entire well and great sensitivity) are impressive, there are several major disadvantages as well. First, the DTS fiber is placed inside the coiled tubing string. Recording temperature data with a reasonable resolution assumes that the fiber has to stay immobile for the entire time needed for data acquisition. Second, as the DTS fiber is a multi-point temperature sensor (i.e., the fiber can record temperature data along the well at multiple locations), there is a significant amount of temperature data transmitted to the surface and being processed for all times and multiple positions along the well. Several solutions have been proposed in literature trying to circumvent these disadvantages. However, these proposed solutions are expensive and not reliable.

SUMMARY OF THE INVENTION

The present invention provides devices and methods that are useful for helping to evaluate the effectiveness of a matrix acidizing treatment. The present invention provides an alternative to DTS technology for matrix acidizing performance evaluation. In a described embodiment, an array of sensors is located at or near the end of the tool string. The sensors are capable of detecting an operational parameter associated with matrix acidizing. In preferred embodiments, the matrix acidizing operational parameters are temperature, pressure, flow rate, flow direction, gamma ray, etc., or any combination of the above. These sensors are disposed upon the outer radial surface of a matrix acidizing bottom hole assembly anywhere along the tool. The sensors are operably interconnected with surface-based signal processing equipment.

The sensor array is separated into a first set of one or more sensors and a second set of one or more sensors. Each of the sets of sensors is capable of detecting a matrix acidizing operational parameter at a particular location within the wellbore at different times. Therefore, moving the bottom hole assembly past a particular location at a particular speed will permit the first and second sets of sensors to detect the operational parameter at the same location at two different times. If desired, more than two sets of sensors can be used, which will permit the operational parameter(s) to be measured at a single location at multiple times.

In operation, the tool string and bottom hole assembly are disposed into the wellbore until the sensors are disposed proximate a formation to be acidized. In currently preferred embodiments, the bottom hole assembly is disposed initially located proximate the lower end of the formation or portion of the formation to be acidized. During acidizing, the sensors detect parameters such as temperature, pressure, etc. related to the acidizing operation in a static location and provide these readings to the processing equipment. If desired, the bottom hole assembly and sensors may be relocated within the formation interval during acidizing to perform acidizing in different parts of the formation. This permits the sensors to provided temperature and/or pressure data from different portions of the formation interval.

After acidizing is completed, the tool string and bottom hole assembly are removed from the wellbore. During removal from the wellbore, the sensors will continue to provide temperature and/or pressure readings to the processing equipment. In a preferred embodiment, the tool string and bottom hole assembly are removed from the wellbore at a predetermined rate of speed so that the first set of sensors will be adjacent a desired location within the wellbore at a first time and the second set of sensors is adjacent the same location at a second time. The desired operational parameter is first detected by the first set of sensors at the first time and then detected by the second set of sensors at the second time, thereby providing detections of the operational parameters at a single point at different times. The matrix acidizing monitoring system of the present invention can be used to provide multiple measurements of operational parameters at multiple points within the formation.

Processing equipment, preferably surface-based, will interpret the data provided. For example, the temperature detected at a particular location along the formation interval is compared at a first time and a second time to determine whether temperature at the location is increasing, decreasing or unchanged at the location. Changes in pressure at the location can be similarly determined. If pressure/temperature changes are detected at multiple points along the formation interval, the changes along the formation interval can be modeled to help determine the effectiveness of the matrix acidizing operation.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
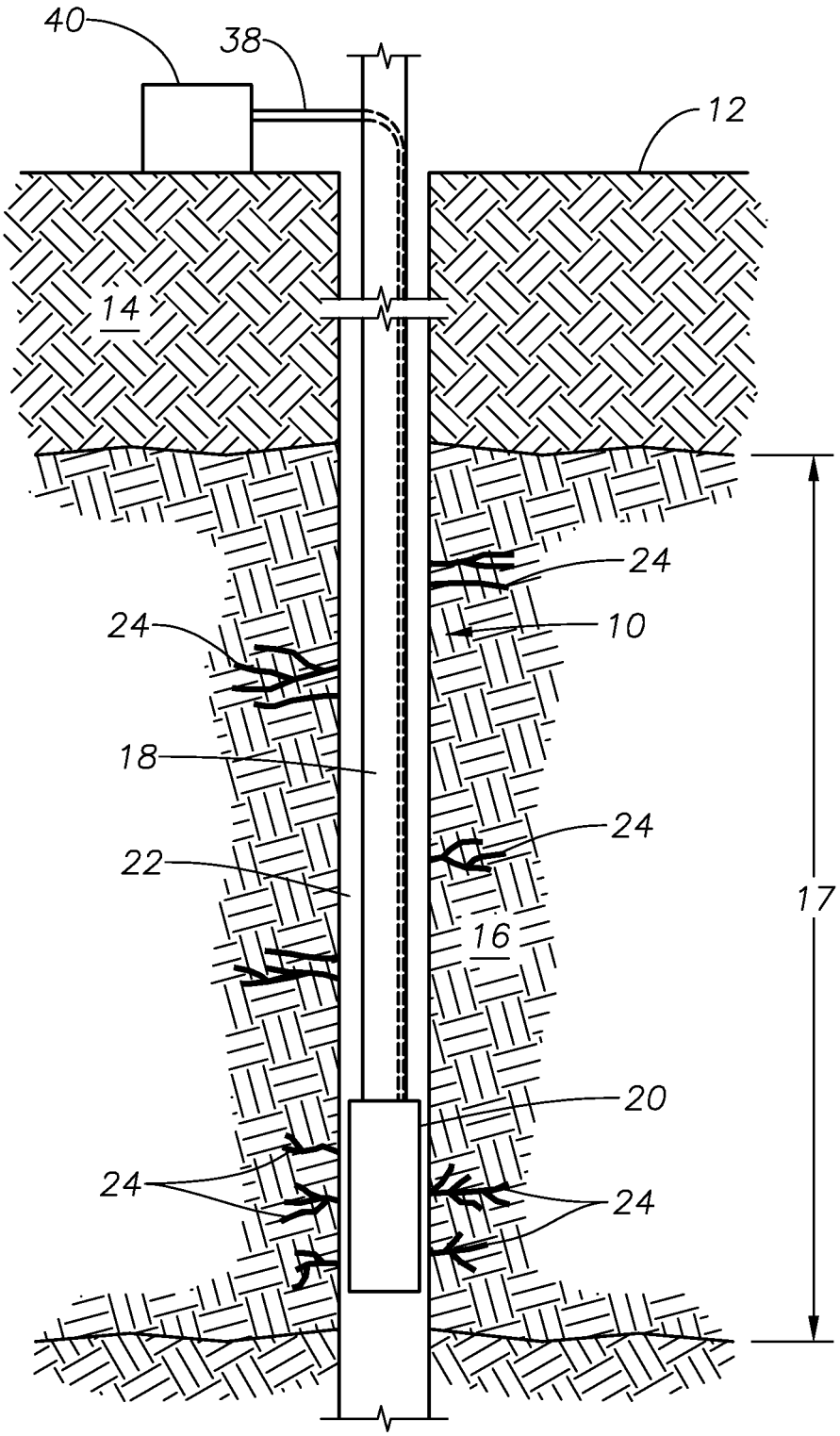
FIG. 1 is a side, cross-sectional view of an exemplary wellbore having a tool string therein for conducting matrix acidizing stimulation and monitoring in accordance with the present invention.

FIG. 1 illustrates an exemplary matrix acidizing operation being conducted within a wellbore and which incorporates a matrix acidizing monitoring system in accordance with the present invention. Wellbore 10 has been drilled from the surface 12 down through the earth 14 to a hydrocarbon-bearing formation 16 within which it is desired to conduct matrix acidizing. The formation 16 has a vertical formation interval 17. A tool string 18 has been run into the wellbore 10 from the surface 12 and carries a bottom hole assembly 20 in the form of a matrix acidizing tool. The bottom hole assembly 20 tool is preferably a metal cylinder having temperature and pressure sensors on its outer surface and connected for signal transmission to the surface, as will be described. In a currently preferred embodiment, the tool string 18 is made up of coiled tubing, of a type known in the art, which can be injected into the wellbore 10. An annulus 22 is formed radially between the tool string 18/bottom hole assembly 20 and the inner wall of the wellbore 10. It is noted that, while FIG. 1 depicts a vertical wellbore 10, this is exemplary only. In fact, the systems and methods of the present invention are applicable to wellbore that are deviated, inclined or even horizontal.

In operation, acid is pumped down the tool string 18 and is injected under pressure through the matrix acidizing bottom hole assembly 20 into the formation 16. The injected acid will enter wormholes 24.

Figure 3:
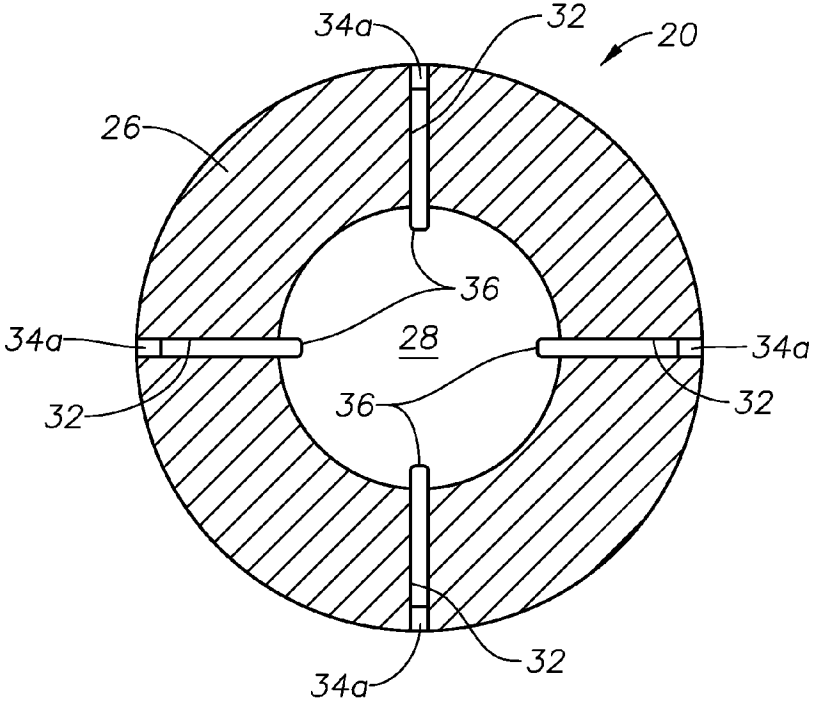
FIG. 3 is an axial cross-section taken along lines 3-3 in FIG. 2.
Figure 2:
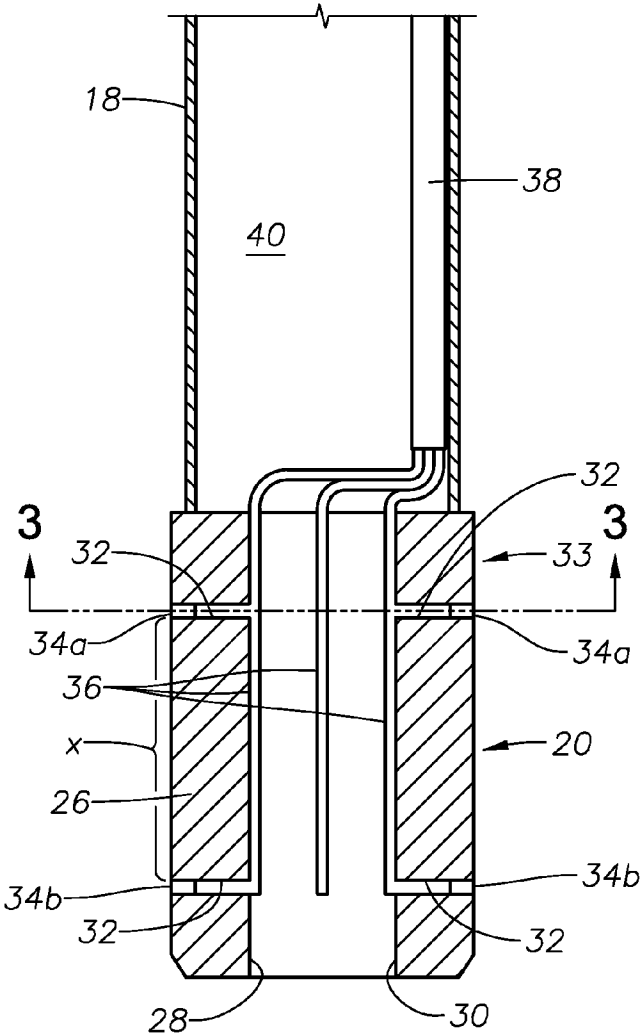
FIG. 2 is an enlarged side, cross-sectional view of an exemplary bottom hole assembly which incorporates a plurality of sensors in accordance with the present invention.
Figure 4:
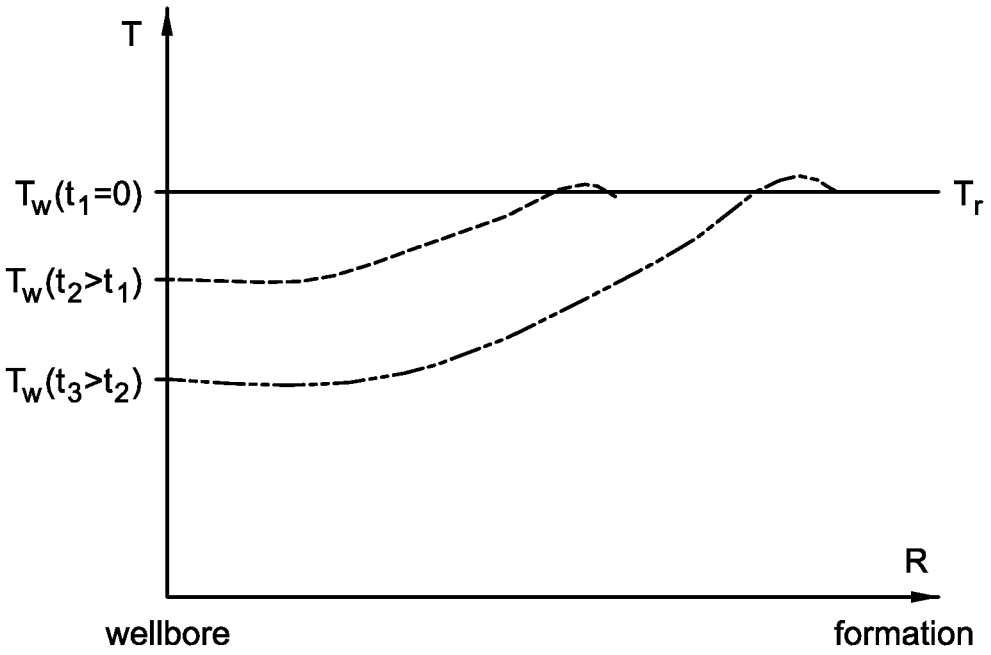
FIG. 4 is a chart illustrating exemplary temperature changes vs. radial distance from a wellbore during acid injection.
Figure 5:
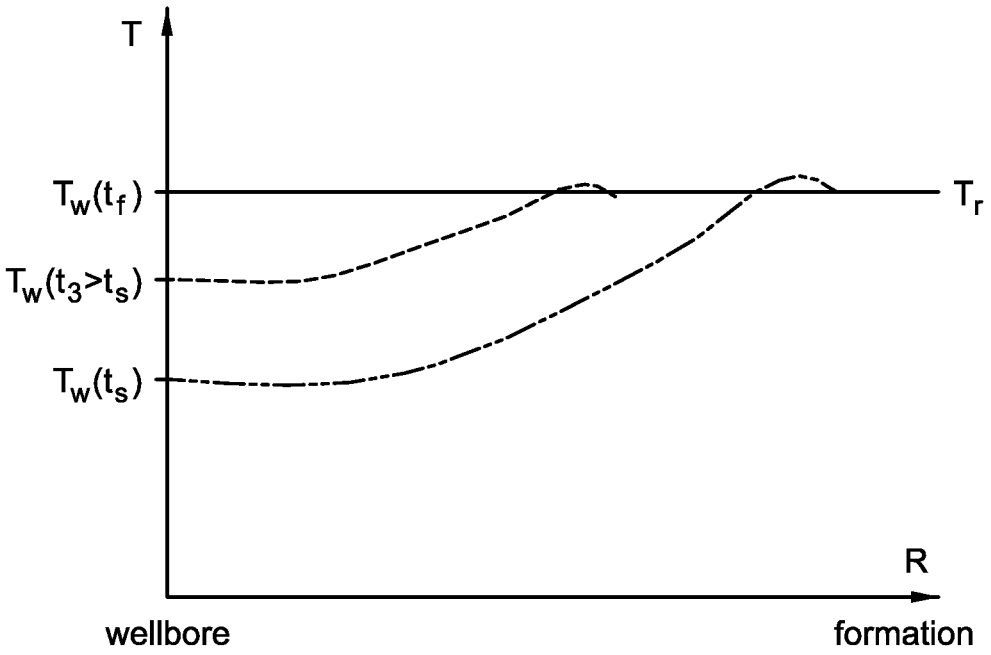
FIG. 5 is a chart illustrating exemplary temperature changes vs. radial distance from a wellbore during acid injection.

FIGS. 2 and 3 illustrate an exemplary bottom hole assembly 20 in greater detail. The exemplary bottom hole assembly 20 includes a generally cylindrical tool body 26 which defines a central axial passage 28 along its length. A nozzle 30 is formed on the distal end of the tool body 26 to allow acid injected down the tool string 18 to enter the formation 16. It should be noted that the figures depict a simplified tool having only a single nozzle 30. In practice, the bottom hole assembly 20 might have multiple nozzles or openings that allow acid to be dispersed in multiple locations and in multiple directions.

Radial passages 32 are drilled through the tool body 26 from the central axial passage 28 to the radial exterior of the tool body 26. A sensor array 33 is provided proximate the lower end of the tool string 18 and preferably upon the tool body 26 of the bottom hole assembly 20. The sensor array 33 includes multiple sensors 34 which are divided into two sets of sensors 34*a*, 34*b*. The first set of sensors 34*a* is axially separated from the second set of sensors 34*b* along the length of the tool body 26 by a length ("x") (see FIG. 2). Each sensor 34 is preferably located at the radially outermost portion of each passage 32. In particularly preferred embodiments, the sensors 34 are transducers that are capable of detecting temperature and generating a signal indicative of the detected temperature. In alternative embodiments, one or more of the sensors 34 are capable of detecting pressure. It is currently preferred that sensors 34 be spaced angularly about the circumference of the tool body 22 in order to obtain sensed parameters from multiple radial directions around the tool body 22. In the depicted embodiment, the sensors 34 are located approximately 90 degrees apart from one another about the circumference of the tool body 22 In the depicted embodiment, there are eight sensors 34. However, there may be more or fewer than eight, as desired.

Electrical cables 36 extend from the sensors 34 to a conduit 38 that is disposed within the central passage 40 of the tool string 18. In a particularly preferred embodiment, the conduit 38 comprises a conductor known in the industry as tubewire, which can be disposed within the coiled tubing to provide a Telecoil conductive system for data/power. The term "tubewire", as used herein, refers to a tube which may or may not encapsulate a conductor or other communication means, such as, for example, the tubewire manufactured by Canada Tech Corporation of Calgary, Canada. In the alternative, the tubewire may encapsulate one or more fiber optic cables which are used to conduct signals generated by sensors 34 that are in the form of fiber optic sensors. The tubewire may consist of multiple tubes and may be concentric or may be coated on the outside with plastic or rubber.

The conduit 38 extends to surface-based signal processing equipment at the surface 12. FIG. 1 illustrates exemplary surface-based equipment to which the conduit 38 might be routed. The conduit 38 is operably interconnected with a signal processor 40 of known type that can analyze and in some cases, record and/or display representations of the sensed temperature and/or pressure parameters. Suitable signal processing software, of a type known in the art can be used to process, record and/or display signals received from the sensors 34. In the instance where the conduit 38 encases optic fibers rather than electrical conductors, the surface-based signal processor 40 includes a fiber optic signal processor. A typical fiber optic signal processor would include an optical time-domain reflectometer (OTDR) which is capable of transmitting optical pulses into the fibers and analyzing the light that is returned, reflected or scattered therein. Changes in an index of refraction in the optic fiber can define scatter or reflection points. The signal processor 40 can include signal processing software for generating a signal or data representative of the measured conditions.

Figure 7:
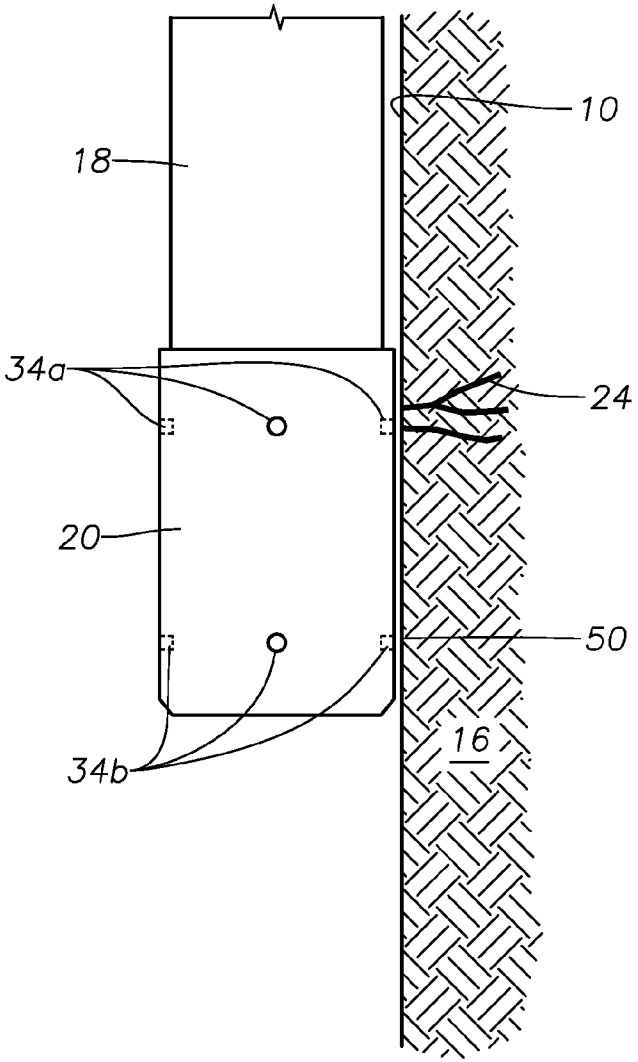
FIG. 7 is a schematic cross-sectional drawing depicting the bottom hole assembly located proximate a location within a formation wherein it is desired to detect matrix acidizing operational parameters at a subsequent second time.
Figure 6:
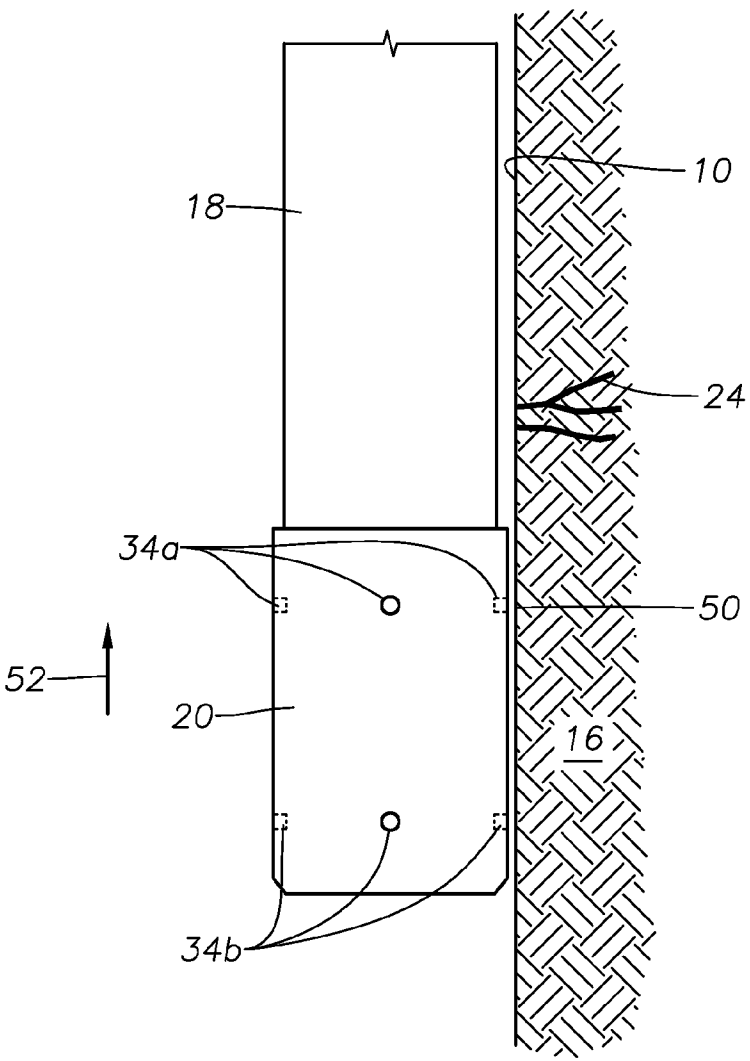
FIG. 6 is a schematic cross-sectional drawing depicting the bottom hole assembly located proximate a location within a formation wherein it is desired to detect matrix acidizing operational parameters at a first time.

In conjunction with the processing equipment 40, the first set of sensors 34*a* is operable to detect at least one matrix acidizing operational parameter at a first time while the second set of sensors 34*b* is operable to detect the same at least one matrix acidizing operational parameter at a second time that is after the first time. The difference between the first and second time is based upon the rate of movement of the sensor array 33 within the formation 16 relative to a particular point of interest. FIGS. 6 and 7 illustrates a bottom hole assembly 20 being moved within the wellbore 10 past a point 50 within the formation 16 at which it is desired to detect at least one matrix acidizing operational parameter. In FIG. 6, the first set of sensors 34*a* is located proximate the point 50. In this position, the sensors 34*a* detect a matrix acidizing operational parameter at the point 50. Thereafter, the tool string 18 is pulled upwardly in the direction of arrow 52 until the bottom hole assembly 20 is in the position shown in FIG. 7. FIG. 7 shows the second set of sensors 34*b* located proximate the point 50. In this position, the second set of sensors 34*b* will detect the same matrix acidizing operational parameter(s) as the first set of sensors 34*a*. The first set of sensors 34*a* detects the parameter(s) at a first time (t1) while the second set of sensors 34*b* detect the parameter(s) at a second time (t2). The rate of movement of the tool string 18 and bottom hole assembly 20 in direction 52 should be coordinated with the timing of detection of the operational parameter(s) by the two sets of sensors 34*a*, 34*b*. This coordination can be conducted, for example, by the processing equipment 40 is such equipment 40 is provided with control over the rate of movement. The processing equipment 40 will compare the operational parameters(s) detected by the first set of sensors 34*a* to the operational parameters(s) detected by the second set of sensors 34*b*. Thus, it can be determined whether the operational parameter is increasing, decreasing or neither. This manner of measuring operational parameters can be repeated for multiple points or locations along the formation interval 17. Additionally, more than two sets of sensors might be employed to provide further detail about the measured operational parameter.

According to an exemplary method of operation, the tool string 18 and bottom hole assembly 20 are disposed into the wellbore 10 and advanced until the bottom hole assembly 20 is proximate the formation 16 into which it is desired to perform matrix acidizing. If desired, packers (not shown) may be set within the annulus 22 in order to isolate the zone into which acid will be released. Thereafter, acid is pumped down the tool string 18 which will then flow through the nozzle 30 of the bottom hole assembly 20 and into the wormholes 24 of the formation 16. During acidizing, temperature and/or pressure is detected by the sensors 34 and provided to the processing equipment 40 at surface 12. During acidizing, the bottom hole assembly 20 might be moved from one location to another within the formation interval 17. Therefore, the sensors 34 will provide temperature and/or pressure readings from different locations within the formation 16.

After the acid injection is stopped at time ($t_s$), the work string 18 is pulled out of the hole at a constant speed that can be calculated depending on the time difference ($t_f$–$t_s$) and the length of the stimulated zone along the well. Thus, the time $t_f$ may be the time that the matrix acidizing bottom hole assembly 20 has traveled the entire well interval of interest. The number of sensors 34 will be dependent on the accuracy of the data acquisition. For instance, a single temperature sensor may not be sufficient for temperature drop data interpretation, as any temperature difference recorded might be due to either axial flow (flow inside the annulus 22) or radial flow (flow between the wellbore 10 and a wormhole 24). However, multiple sensors 34 could accurately identify of a recorded temperature variation is due to axial flow or radial flow. At least two temperature sensors 34 should be installed sufficiently far away from each other such that they capture temperature differences due to radial acid flow. In particular embodiments, the minimum distance between two temperature sensors 34 is greater than the radial diameter of the wormholes. Thus, it is preferred that the sensors 34 are spaced apart from each other on the tool body 22 by a distance that is greater than the diameter of the wormholes 24. Theoretical calculations show that the minimum distance between two temperature sensors 34 should be between 4 and 20 meters (13-66 feet), depending upon the reservoir properties (porosity, permeability, wormhole size and shape, geothermal gradient, thermal conductivity, etc.) and well details (shape, dimensions, completion type, etc.). The method could be refined by adding temperature sensors between the two end sensors. Adding more temperature sensors in between increases the accuracy of temperature variation measurement. In addition to the temperature sensors, other sensor types could be used. For instance, pressure sensors could also be installed. Both temperature and pressure measurements are useful in accurately evaluating the matrix acidizing performance when they are coupled with a mathematical model that solves the classical energy flow equation inside the well:

$$\frac{\partial}{\partial t}\left[\rho\left(u+\frac{1}{2}v^2\right)\right]+\frac{\partial}{\partial z}\left[\rho v\left(h+\frac{1}{2}v^2\right)\right]=Q$$

where ρ is acid density, t and z are time and the curvilinear coordinated along the well path, v is acid velocity, $u=c_p(T-T_{ref})$ and $h=u+p/\rho$ are the specific internal energy and enthalpy, respectively, $c_p$ is the specific heat defined at reference temperature $T_{ref}$, and T and p are acid temperature and pressure. Note also that Q is the term that includes all other heat exchange effects, such as heat loss due to acid flowing into/from formation.

The inventors have found that using an array of single-point temperature and pressure sensors at the end of the tool string 18 and pulling them out of the wellbore 10 at a pre-calculated speed has major advantages over DTS technology. First, the acquired data volume is much smaller. This makes the data interpretation process faster and less prone to errors. Second, as the tool string 18 and single point sensors 34 are pulled out of the wellbore 10 after the acid injection has been stopped (at time $t=t_s$), the operator brings the tool string 18 back to the surface 12 in a shorter time. A DTS fiber and coiled tubing must stay immobile until all data is recorded (usually until time $t_f$) and then pulled out of the wellbore. Systems and method in accordance with the present invention permit the use of robust, durable conduits, such as tubewire/Telecoil technology. These advantages translate to lower operational costs for the matrix acidizing performance evaluation process when an array of single point sensors 34 at the end of the tool string 18 is used. After real-time downhole temperature and pressure data is acquired and interpreted, the acidizing performance can be visualized by knowing how much acid was injected where. This information is useful for understanding how the formation 16 was treated and if more acidizing is necessary to obtain expected acidizing performance.

Those of skill in the art will recognize that numerous modifications and changes may be made to the exemplary designs and embodiments described herein and that the invention is limited only by the claims that follow and any equivalents thereof.

What is claimed is:

1. A matrix acidizing monitoring system comprising:

a bottom hole assembly to conduct matrix acidizing in a wellbore, the bottom hole assembly having a tool body;

a sensor array operably associated with the bottom hole assembly and having first and second sets of sensors, each of the first and second sets of sensors being operable to detect a matrix acidizing operational parameter at a location in the wellbore;

the first set of sensors detecting the parameter at the location at a first time as the first set of sensors is moved past the location; and the second set of sensors detecting the parameter at the location at a second time as the second set of sensors is moved past the location.

2. The matrix acidizing monitoring system of claim 1 wherein at least one of the sensors in the sensor array comprises a transducer for sensing temperature and/or pressure.

3. The matrix acidizing monitoring system of claim 1 further comprising a signal processor operably interconnected with the sensor array to compare the parameter detected by the first set of sensors to the parameter detected by the second set of sensors.

4. The matrix acidizing monitoring system of claim 1 wherein the first set of sensors and the second set of sensors are disposed upon the bottom hole assembly, and further wherein the first and second sets of sensors are axially spaced apart from each other upon the bottom hole assembly.

5. The matrix acidizing monitoring system of claim 1 wherein the bottom hole assembly is moved within the wellbore from a first position wherein the first set of sensors detects the parameter to a second position wherein the second set of sensors detects the parameter.

6. The matrix acidizing monitoring system of claim 3 further comprising a conductor to conduct signals from the sensor array to the signal processor.

7. The matrix acidizing monitoring system of claim 1 wherein the matrix acidizing operational parameter comprises temperature and/or pressure.

8. A matrix acidizing monitoring system comprising:

a bottom hole assembly to conduct matrix acidizing in a wellbore, the bottom hole assembly having a tool body;

a sensor array operably associated with the bottom hole assembly and having first and second sets of sensors, each of the first and second sets of sensors being operable to detect a matrix acidizing operational parameter at a location in the wellbore;

the first set of sensors and the second set of sensors located upon the tool body;

the first set of sensors detecting the parameter at the location at a first time as the first set of sensors is moved past the location;

the second set of sensors detecting the parameter at the location at a second time as the second set of sensors is moved past the location; and processing equipment to receive signals from the sensors representative of the detected parameters and to compare the parameter detected by the first set of sensors to the parameter detected by the second set of sensors.

9. The matrix acidizing monitoring system of claim 8 wherein at least one of the sensors in the sensor array comprises a transducer for sensing temperature and/or pressure.

10. The matrix acidizing monitoring system of claim 8 wherein the bottom hole assembly is moved within the wellbore from a first position wherein the first set of sensors detects the parameter to a second position wherein the second set of sensors detects the parameter.

11. The matrix acidizing monitoring system of claim 8 further comprising a conductor to conduct signals from the sensor array to the signal processor.

12. The matrix acidizing monitoring system of claim 8 wherein the matrix acidizing operational parameter comprises temperature and/or pressure.

13. A method of monitoring a matrix acidizing operation within a subterranean formation in a wellbore, the method comprising:

disposing a bottom hole assembly proximate the formation in the wellbore, the bottom hole assembly having a tool body, a first set of sensors and the second set of sensors located upon the tool body;

conducting a matrix acidizing operation through the bottom hole assembly into the formation;

detecting a matrix acidizing operational parameter at a location within the wellbore with the first set of sensors as the first set of sensors is moved past the location;

detecting the matrix acidizing operational parameter at the location with the second set of sensors as the second set of sensors is moved past the location; and comparing the parameter detected by the first set of sensors to the parameter detected by the second set of sensors.

14. The method of claim 13 wherein:

the bottom hole assembly is moved within the wellbore from a first position wherein the first set of sensors detects the parameter to a second position wherein the second set of sensors detects the parameter.

15. The method of claim 13 wherein the first and second sets of sensors detect the operational parameter at multiple points along the wellbore.

* * * * *